US005408934A

United States Patent [19]

Hall

[11] Patent Number: 5,408,934

[45] Date of Patent: Apr. 25, 1995

[54] NON-CONDUCTIVE WHEEL CHOCK

[76] Inventor: Thomas Hall, 10070 Davis Hill Rd., East Concord, N.Y. 14055

[21] Appl. No.: 124,925

[22] Filed: Sep. 21, 1993

[51] Int. Cl.[6] ..... B61K 13/00

[52] U.S. Cl. ..... 104/257

[58] Field of Search ..... 104/257, 258; 188/32

[56] References Cited

U.S. PATENT DOCUMENTS

| | | | |
|---|---|---|---|
| 1,521,497 | 12/1924 | Young | 188/32 |
| 1,565,801 | 12/1925 | Hewlett | 188/32 |
| 1,789,958 | 1/1931 | Crews | 104/258 |
| 2,003,747 | 6/1935 | Hester | 104/258 |
| 2,253,829 | 8/1941 | Werner | 104/257 |
| 2,771,162 | 11/1956 | Marsh | 188/32 |

FOREIGN PATENT DOCUMENTS

| | | | |
|---|---|---|---|
| 104068 | 9/1898 | Germany | 104/258 |
| 3442146 | 5/1986 | Germany | 188/32 |
| 2220182 | 1/1990 | United Kingdom | 104/258 |
| 8909709 | 10/1989 | WIPO | 188/32 |

*Primary Examiner*—Mark T. Le

*Attorney, Agent, or Firm*—Howard J. Greenwald; James F. Mudd

[57] ABSTRACT

An electrically non-conductive wheel chock for restraining the movement of a wheel which contains a body, an arm attached to the body extending outwardly and upwardly from the body, and a device for preventing the movement of the wheel check upon the rail. The top portion of the wheel chock body contains a first ramp, a top deck, and a second ramp. The bottom portion of the wheel chock body contains a downwardly-extending leg and an arcuate surface joined to the leg. The body has a compressive modulus of at least about 400,000 pounds per square inch.

17 Claims, 3 Drawing Sheets

NON-CONDUCTIVE WHEEL CHOCK

FIELD OF THE INVENTION

A non-conductive wheel chock which is especially useful for restraining the movement of parked railroad vehicles.

BACKGROUND OF THE INVENTION

As is known to those skilled in the art, a subway is an underground urban railroad which usually is operated by electricity. See, e.g., U.S. Pat. Nos. 5,108,171, 4,854,078, 4,573,559, 4,233,904, 4,081,083, 4,008,577, 3,999,394, 3,914,946, 3,851,881, and 3,704,064. The disclosure of each of these patents is hereby incorporated by reference into this specification.

The electrical power required to move subway trains is usually transmitted by means of a "third rail" which runs parallel to one of the rails of the subway track. See, e.g., FIG. 2 of page 346 of the McGraw-Hill Encyclopedia of Science & Technology, Volume 11 (McGraw-Hill Book Company, New York, 1977).

It is often necessary to park a subway train on the rails of a subway track when such train is not in use and/or is being serviced and to restrain the movement of such a train.

It is an object of this invention to provide a wheel chock which can be readily wedged between the wheel of a subway train and a track and can readily and effectively prevent the movement of such wheel and such train.

It is another object of this invention to provide a wheel chock which is electrically non-conductive and, thus, will not conduct electricity from the third rail of a subway system to any portion of a subway car.

It is yet another object of this invention to provide a wheel chock which is comprised of means for readily wedging it between a wheel and a track.

It is yet another object of this invention to provide a wheel chock comprised of means for preventing the sliding movement of such wheel chock on a subway track.

It is yet another object of this invention to provide a wheel chock which may be wedged between a wheel and a rail from either side of the railroad car.

SUMMARY OF THE INVENTION

In accordance with this invention, there is provided a wheel chock apparatus comprised of a body and an arm extending from the top portion of such body. The body, which consists essentially of plastic, is preferably an integral structure which has at least one downwardly-extending leg adapted to fit over one side of the rail of a subway track.

BRIEF DESCRIPTION OF THE DRAWINGS

The present invention will be more fully understood by reference to the following detailed description thereof, when read in conjunction with the attached drawings, wherein like reference numerals refer to like elements, and wherein.

DESCRIPTION OF THE PREFERRED EMBODIMENTS

Figure 1:
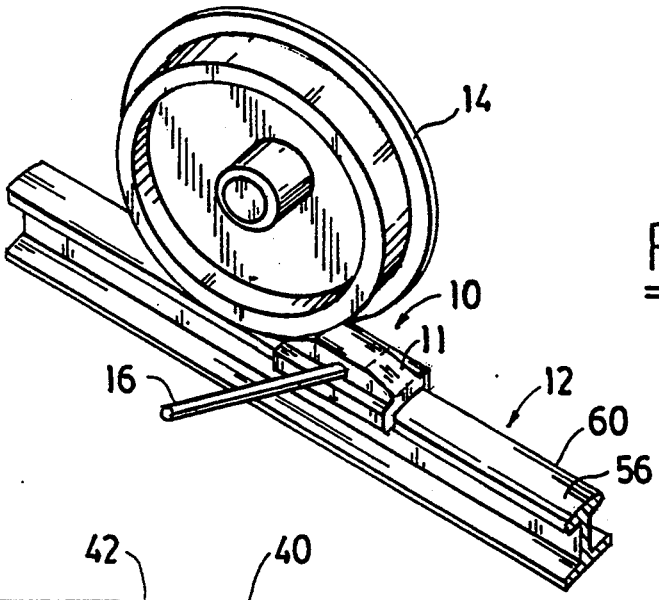
FIG. 1 is a perspective view of one preferred embodiment of applicant's wheel chock shown restraining the wheel of a railroad car.
Figure 2:
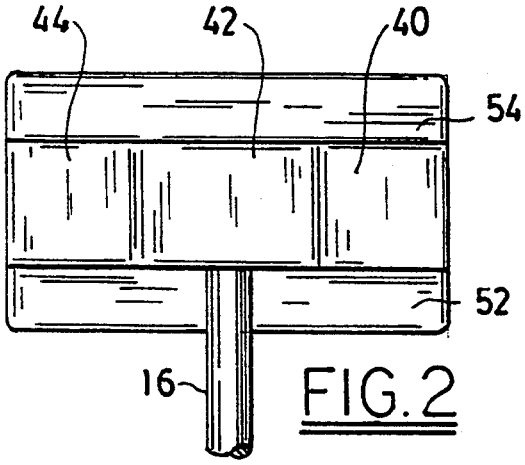
FIG. 2 is a top view of the wheel chock of FIG. 1.

FIG. 1 is a perspective view of one preferred wheel chock 10 shown disposed on rail 12 and restraining the movement of wheel 14. Wheel 14 is preferably attached to a railroad vehicle (not shown) which, for the sake of simplicity, has been omitted from the Figures.

The wheel chock 10 of this invention is substantially non-conductive and, thus, cannot cause shorting between the main rail of a subway system and a third rail. As is known to those skilled in the art, direct current conductivity is the ratio of the current density passing through a specimen at a given instant of time and under prescribed conditions, to the direct current potential gradient paralleling the current. It is the reciprocal of the d.c. conductivity. See, e.g., A.S.T.M. D2864 and D27.

Because of its non-conductive nature, when arm 16 is placed into contact with a third rail of a subway system (not shown), no current will flow between said third rail (not shown) and the track 12. Thus, referring to FIG. 4, if an electrically conductive wire is connected to end 20 of arm 16, and thence to direct current source 22 and thence to side 24 of wheel chock 10, no current flows through wheel chock 10 even when the direct current source is as high as 600 volts direct current. As will be apparent to those skilled in the art, the presence of current flow may be detected by a conventional ammeter 26.

In addition to being non-conductive, applicant's wheel chock 10 also has sufficient impact resistance so as not to shatter or fracture when subjected to the forces encountered in normal use. This impact resistance of the plastic material used in wheel chock 10 may be measured by A.S.T.M. Standard Test D695-85, "Test Method for Compressive Properties of Rigid Plastics." When tested in such a manner, the plastic material has a compressive modulus of at least about 400,000 pounds per share inch and, preferably, at least about 1,000,000 pounds per square inch.

In one preferred embodiment, the plastic material used in wheel chock 10 is comprised of at least one filler. As is known to those skilled in the art, fillers are non-metallic minerals, metallic powders, and organic materials which are used to increase stiffness, reduce mold shrinkage, improve processing, decrease resistance, and lower costs to the compounder. See, e.g., pages 201–220 of the "Modern Plastics Encyclopedia," which is the Mid-October, 1991 issue of Modern Plastics (Volume 68, Number 11) published by Modern Plastics of P.O. Box 481, Highstown, N.J.

In this preferred embodiment, at least one of the fillers used in the wheel chock 10 of this invention preferably is a fibrous reinforcement. In this embodiment, such fibrous filler comprises at least about 10 volume percent (by total volume of the material in wheel chock 10) of fiber. In a more preferred embodiment, such fibrous filler comprises at least about 20 volume percent of it.

The fibrous filler used in this preferred embodiment preferably consists essentially of non-conductive material such as, e.g., fiberglass, "KEVLAR" (an aromatic polyamide fiber of extremely high tensile strength manufactured by the E.I du Pont de Nemours and Company of Wilmington, Del.), nylon strands, polyester fiber, hemp.

In one preferred embodiment, the fibrous filler is fiberglass fiber which has a nominal diameter of from about 3 to about 18 microns and a maximum dimension of at least about 0.2 inches. In another embodiment, the fibrous filler is fiberglass staple sliver with a nominal diameter of from about 8 to about 16 microns. As is known to those skilled in the art, this material is commercially known as and available as "E-glass."

In one preferred embodiment, in addition to the fibrous filler, the plastic material comprising wheel chock 10 also comprises an inorganic filler such as, e.g., calcium carbonate, alumina, alumina trihydrate, talc, mica, ground clay, marble dust, and the like. In general, in this embodiment, the particle size of this additional filler is such that substantially all of the particles of such filler have a maximum dimension which is smaller than about 10 microns. In this embodiment, it is preferred that the plastic material comprising wheel chock 10 contain at least about 30 volume percent (by total volume of resin and filler) of such particulate filler and, more preferably, at least about 50 volume percent of such particulate filler.

In addition to the fibrous reinforcing agent and/or the particulate reinforcing agent, the wheel chock 10 also comprises resin. Any conventional resin which will yield a product with the desired compressive strength may be used. Thus, by way of illustration and not limitation, one may use methyl methacrylate (see pages 11–14 of said Modern Plastics Encyclopedia), polyester thermoset resins (see pages 132–134 of such Encyclopedia), vinyl based resins (see pages 122–123 of such Encyclopedia), and the like.

In one preferred embodiment, the resin used is "MODAR 814," a modified acrylic resin sold by ICI Acrylics Inc. of 10091 Manchester Road, St. Louis, Mo. This resin is a glass filled material which has a flexural strength of at least 14,000 p.s.i., and a flexural modulus of at least 500,000 p.s.i.

Referring again to FIG. 1, it will be seen that the wheel chock 10 is comprised of both a body 11 and, extending outwardly therefrom, an arm 16. The composition of the body 11 has been described heretofore in this specification; the nature and composition of the arm 16 will now be described.

Figure 4:
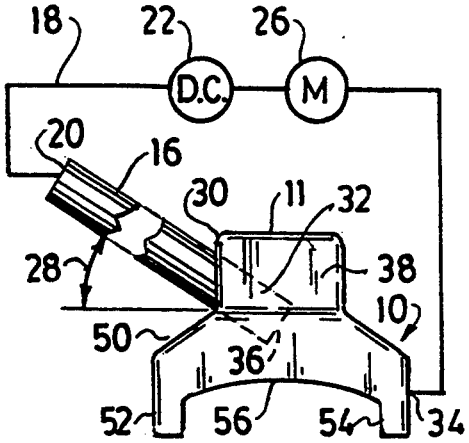
FIG. 4 is an end view of the wheel chock of FIG. 1.

As will be seen from FIGS. 1 and 4, arm 16 preferably extends upwardly and outwardly from body 11 of wheel chock 10. Thus, referring to FIG. 4, arm 16 preferably forms an angle 28 of from about 10 to about 45 degrees with side surface 30 of body 11. Consequently, arm 16 extends above both rail 12 and wheel chock 10 and may be more readily grabbed by a railroad employee.

Body 11 of wheel check 10 is comprised of an orifice (not shown) into which arm 16 fits. Such orifice preferably has a substantially circular cross-sectional shape, although other shapes may be used; and end 32 of arm 16 is disposed within such orifice and attached to body 11 by conventional means.

In one embodiment, arm 16 is adhesively joined to body 11. In another embodiment, arm 16 is friction fit within the orifice in body 11. In yet another embodiment, end 32 of arm 16 is comprised of threads which mate with corresponding threads in body 11. Other conventional joining means known to those skilled in the art also may be used.

Arm 16 is preferably non-conductive. Thus, referring to FIG. 4, if wire end 34 were connected to end 36 of arm 16 and the 600 volt direct current applied to such circuit, substantially no current would flow through arm 16.

In one preferred embodiment, arm 16 consists essentially of an extruded fiberglass/resin mixture and contains at least about 60 volume percent of fiberglass and, preferably, at least about 70 volume percent of fiberglass. In this embodiment, any of the resins discussed for use in the body 11 also may be used in arm/handle 16.

In one preferred embodiment, illustrated in FIG. 1, arm 16 is in the shape of a rod with a diameter of from about 0.6 to about 1.0 inches.

Figure 3:
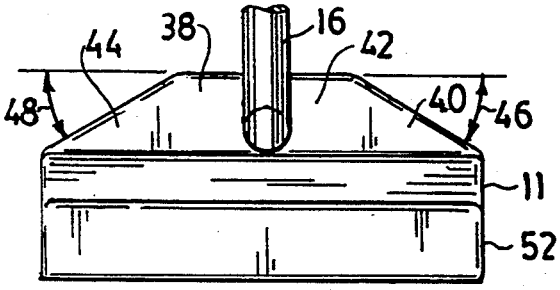
FIG. 3 is a side view of the wheel chock of FIG. 1.

Referring to FIG. 3, it will be seen that body 11 is an integral structure comprised of a top portion 38. Such top portion 38 is comprised of a first ramp 40, a top deck 42, and a second ramp 44.

Referring to FIG. 3, it will be seen that each of ramps 40 and 44 form an angle 46 and an angle 48 (which may be the same as each other, or may be different) of from about 20 to about 70 degrees and, preferably, from about 30 to about 45 degrees.

Figure 5:
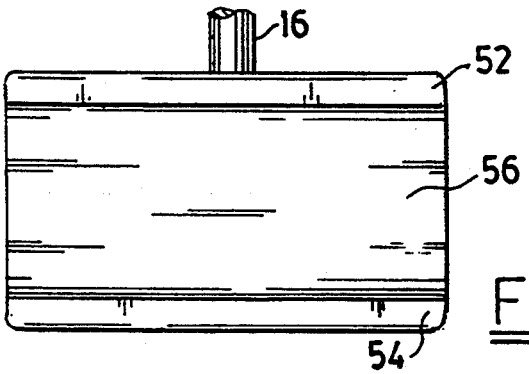
FIG. 5 is a bottom view of the wheel chock of FIG. 1.

Referring again to FIGS. 4 and 5, and in the preferred embodiment illustrated therein, it will be seen that body 11 also is comprised of a bottom portion 50 which preferably is integrally formed with top portion 38 and which is comprised of downwardly-extending legs 52 and 54 which are adapted to engage the crown portion 56 of rail 12. As will be seen from FIG. 4, legs 52 and 54 are integrally formed with a bottom arcuate surface 56 which substantially conforms with the crown portion 56 of rail 12.

Figure 6:
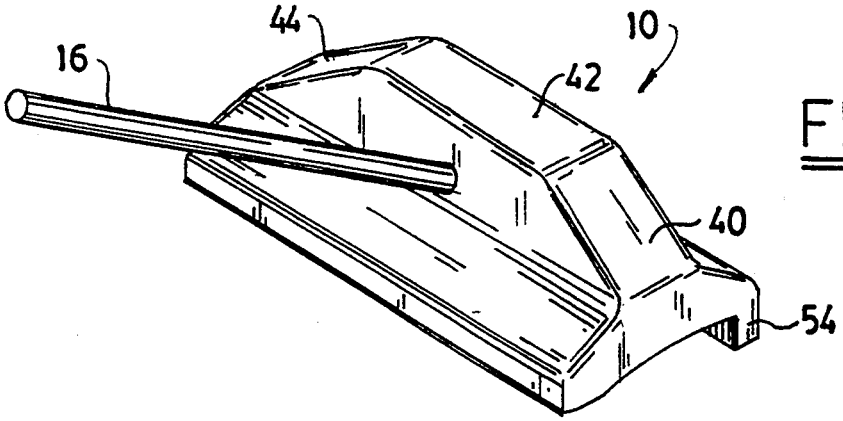
FIG. 6 is a perspective view of another preferred wheel chock.
Figure 7:
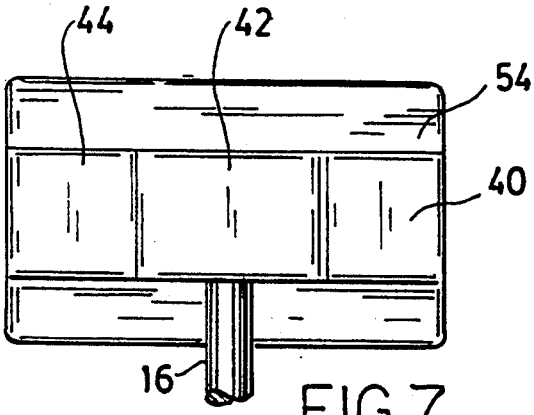
FIG. 7 is a top view of the wheel chock of FIG. 6.
Figure 8:
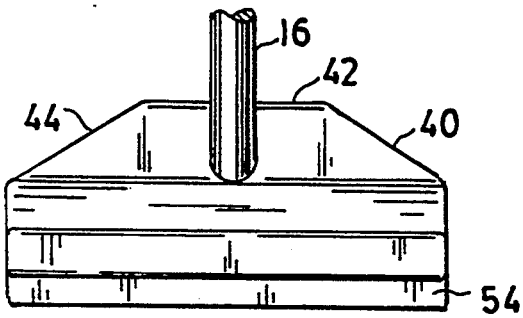
FIG. 8 is a side view of the wheel chock of FIG. 6.
Figure 9:
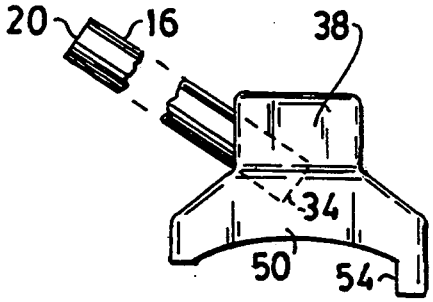
FIG. 9 is an end view of the wheel chock of FIG. 6.
Figure 10:
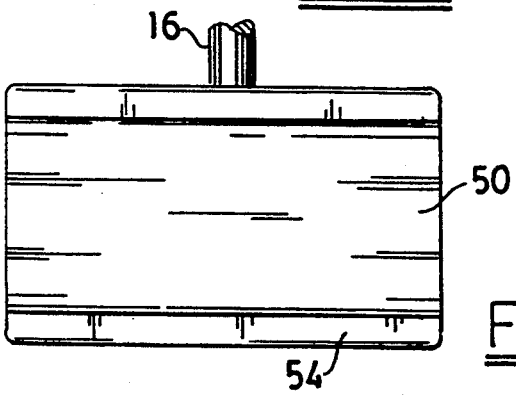
FIG. 10 is a bottom view of the wheel chock of FIG. 6.

FIG. 6 illustrates another preferred embodiment of wheel chock 10 which is substantially identical to the embodiment depicted in FIG. 1 through 5 with the exception that bottom portion 50 has only one downwardly-extending leg, such as, e.g., leg 54. In the embodiment depicted, leg 54 is on the side of the wheel chock 10 which is opposite the arm 16. In another embodiment, not shown, leg 54 is on the same side of the wheel chock 10 as is arm 16. As will be apparent to those skilled in the art, the use of this "one-legged" embodiment allows the railroad employee to locate the edge 60 of crown area 56 (see FIG. 1) by feel, but it does not require as much skill to place on rail 12 as does the wheel chock of FIGS. 1–5. Furthermore, the embodiment of FIGS. 6–10 allows the railroad employee to more readily disengage the wheel chock 10 from rail 12 than is possible with the embodiment of FIGS. 1–5.

In FIGS. 11–14, an embodiment of wheel chock 10 which contains means for preventing the sliding movement of wheel chock 10 on rail 12 are illustrated. In these Figures, for the sake of simplicity, the arm 16 has not been shown. Furthermore, although these Figures have been illustrated showing the embodiment with two downwardly-extending arms 52 and 54 (see FIGS. 1–5), it will be apparent to those skilled in the art that the embodiment utilizing only one downwardly extending arm 54 (see FIGS. 6–10) also may be utilized with the means for preventing the sliding movement of wheel chock 10 on rail 12.

As is known to those skilled in the art, crown portion 56 of rail 12 generally consists essentially of steel; and such crown portion 56 has often been worn flat and smooth by repeated contact with wheel 14. If the wheel chock 10 is able to slide easily on crown portion 56 upon the application of force on either ramp 40 or 44 by wheel 14, it will not serve its intended purpose of restraining the movement of wheel 14.

Thus, in the preferred embodiment illustrated in FIGS. 11–14, bottom section 50 is provided with means for inhibiting the sliding movement of wheel chock 10 on rail 12.

Figure 11:
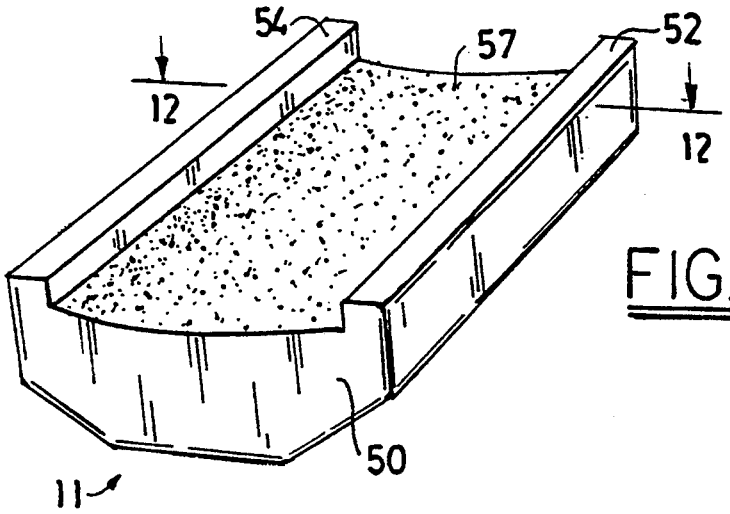
FIG. 11 is a perspective view of yet another preferred wheel chock of the invention.
Figure 12:
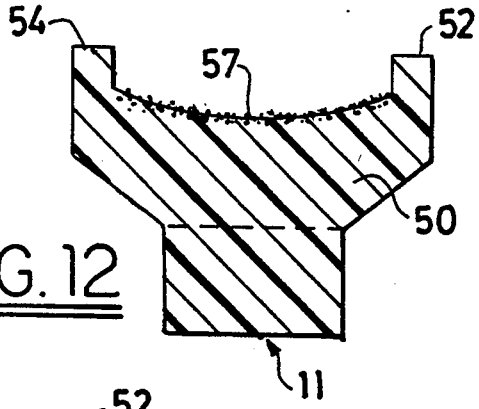
FIG. 12 is a sectional view, taken along lines 12—12 of FIG. 11, of the wheel chock of FIG. 11.

In one preferred embodiment, illustrated in FIGS. 11 and 12, the means for preventing the sliding movement of wheel chock 10 on rail 12 comprise a gritty arcuate surface 57. The grit in surface 57 to prevent the undesired sliding motion.

The grit in surface 57 preferably consists essentially of a granular material. As is known to those skilled in the art, grit is an abrasive material comprised of angular grains.

Many grits are well known to those skilled in the art and may be used in applicant's invention. Thus, e.g., one may use one or more of the grits described in U.S. Pat. Nos. 5,105,612 (carbide grit), 5,100,280 (ferrous grit), 5,094,672 (sol-gel abrasive grit), 5,085,171, 5,069,882 (refractory grit), 5,066,335 (polysaccharidge abrasive grit), 5,062,865 (cubic boron nitride abrasive grit), 5,052,153, 5,048,235, 5,046,289, 5,038,500, 5,036,737 (diamond grit), 5,036,561, 5,028,177, 5,024,026, 5,022,895, and the like. The disclosure of each of these United States patents is hereby incorporated by reference into this specification.

In one preferred embodiment, the grit used consists essentially of a refractory carbide selected from the group consisting of silicon carbide, tungsten carbide, boron carbide, and tantalum carbide. Preferably such carbide grit is a coarse grit.

Gritty surface 57 may be formed by any conventional means such as, e.g., the means disclosed in one or more of such United States patents. In one embodiment, not shown, the body 11 is made by a conventional casting technique such as that which is disclosed on pages 435–461 of Joel Frados' "Plastics Engineering Handbook," Fourth Edition (Van Nostrand Reinhold Company, New York, 1976). After the body 11 has been made by such casting method, a layer of grit may be deposited on the bottom surface 56 of body 11 (see FIG. 4), and resin (not shown) may be poured onto such grit to adhere it to surface 56, thereby forming surface 57. Other well known means of forming a grit surface also may be used.

Figure 13:
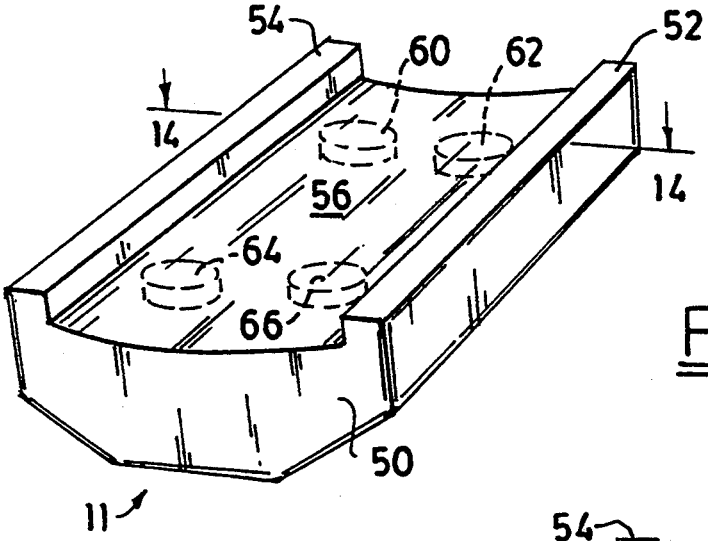
FIG. 13 is a perspective view of yet another preferred wheel chock view of the invention.
Figure 14:
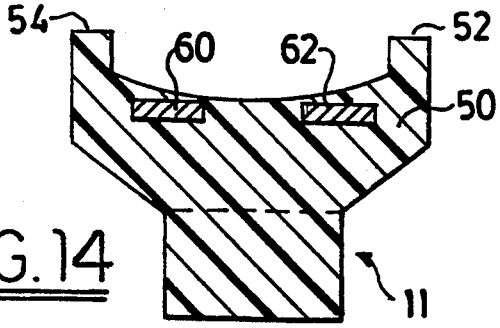
FIG. 14 is a sectional view, taken along lines 14—14 of FIG. 13, of the wheel chock of FIG. 13.

FIGS. 13 and 14 illustrate another means of forming a means for inhibiting the sliding of wheel chock 10 on rail 12. In the embodiment of these Figures, magnets 60, 62, 64, and 66 are attached to surface 56 by conventional means and form a removable and magnetic attachment between wheel chock 10 and rail 12. In one embodiment, body 11 is produced by the aforementioned means and, thereafter, magnets 60, 62, 64, and 66 are disposed on bottom surface 56 of body 11. Thereafter, resin is poured around magnets 60, 62, 64, and 66 to bond them to surface 56. Alternatively, or additionally, magnets 60, 62, 64, and 66 may be adhesively bonded to surface 56.

As will be apparent to those skilled in the art, other means may be used to prevent the slidable motion of wheel chock 10 on rail 12. Thus, e.g., metal claws or teeth may be disposed in and/or on the surface 56 of body 11.

In one embodiment, the wheel chock 10 is substantially non-reactive with the elements and compounds normally found in air.

It is to be understood that the aforementioned description is illustrative only and that changes can be made in the apparatus, in the ingredients and their proportions, and in the sequence of combinations and process steps, as well as in other aspects of the invention discussed herein, without departing from the scope of the invention as defined in the following claims.

I claim:

1. A wheel chock for restraining the movement of a wheel, comprised of a body, an arm attached to said body extending outwardly and upwardly from said body, means for removably mounting said wheel chock upon a rail, and means for preventing the movement of said wheel chock upon said rail, wherein:

(a) the body of said wheel chock is formed of a material such that when a difference of potential of at least about 600 volts of direct current is applied across said wheel chock, no current flows through said wheel chock; and (b) said body is comprised of a top portion and a bottom portion integrally joined to each other, wherein:

1. said top portion is comprised of a first ramp, a top deck, and a second ramp, wherein each of said ramps form an angle with said top deck of from about 20 to about 70 degrees,
2. said bottom portion is comprised of a first, downwardly-extending leg adapted to engage said rail,
3. said bottom portion is comprised of an arcuate surface joined to said first, downwardly-extending leg, and
4. said body has a compressive modulus of at least about 400,000 pounds per square inch.

2. The wheel chock as recited in claim 1, wherein said arcuate surface is comprised of grit.

3. The wheel chock as recited in claim 2, wherein said grit is a refractory carbide.

4. The wheel chock as recited in claim 3, wherein said refractory carbide is selected from the group consisting of silicon carbide, tungsten carbide, boron carbide, and tantalum carbide.

5. The wheel chock as recited in claim 1, wherein said arm is substantially non-conductive.

6. The wheel chock as recited in claim 1, wherein said body consists essentially of a substantially homogeneous material which has a compressive modulus of at least about 1,000,000 pounds per square inch.

7. The wheel chock as recited in claim 6, wherein said homogeneous material is comprised of at least 10 volume percent of fibrous filler material.

8. The wheel chock as recited in claim 7, wherein said fibrous filler material is fiberglass.

9. The wheel chock as recited in claim 8, wherein said fiberglass has a nominal diameter of from about 3 to about 18 microns.

10. The wheel chock as recited in claim 7, wherein said homogeneous material is comprised of at least about 30 volume percent of a particulate inorganic filler substantially all of whose particles have a maximum dimension of less than about 10 microns.

11. The wheel chock as recited in claim 7, wherein said homogeneous material is comprised of resin.

12. The wheel chock as recited in claim 11, wherein said resin is methyl methacrylate.

13. The wheel chock as recited in claim 1, wherein said arm forms an angle with said body of from about 10 to about 45 degrees.

14. The wheel chock as recited in claim 1, wherein said body is comprised of an orifice.

15. The wheel chock as recited in claim 1, wherein said arm consists essentially of an extruded mixture of fiberglass and resin and is comprised of at least about 70 volume percent of fiberglass.

16. The wheel chock as recited in claim 15, wherein said arm is in the shape of a rod with a diameter of from about 0.6 to about 1.0 inches.

17. The wheel chock as recited in claim 1, wherein said wheel chock is comprised of a second, downwardly-extending leg.

* * * * *